United States Patent [19]

Musselmann et al.

[11] Patent Number: 4,911,828

[45] Date of Patent: Mar. 27, 1990

[54] REJECTS SORTING APPARATUS

[75] Inventors: Walter Musselmann; Reimund Rienecker; Herbert Kinzler, all of Heidenheim, Fed. Rep. of Germany

[73] Assignee: J.M. Voith GmbH, Heidenheim, Fed. Rep. of Germany

[21] Appl. No.: 366,234

[22] Filed: Jun. 12, 1989

Related U.S. Application Data

[63] Continuation of Ser. No. 15,747, Feb. 17, 1987, abandoned.

[30] Foreign Application Priority Data

Feb. 7, 1987 [DE] Fed. Rep. of Germany ..... 3703831

[51] Int. Cl.[4] ..... B07B 1/20

[52] U.S. Cl. ..... 209/273; 162/55; 209/268; 209/380; 210/403; 210/404; 241/74

[58] Field of Search ..... 209/268, 273, 300, 305, 209/306, 270, 380, 234, 289, 290; 210/403, 404, 415; 241/74; 162/261, 55; 19/7, 8, 27, 28, 34

[56] References Cited

U.S. PATENT DOCUMENTS

| | | | |
|---|---|---|---|
| 1,092,389 | 4/1914 | Qviller et al. | 209/273 |
| 1,209,264 | 12/1916 | Haug | 209/273 |
| 1,537,691 | 5/1925 | Priem | 209/273 |
| 2,974,796 | 3/1961 | Jung | 209/300 |
| 3,616,904 | 11/1971 | Aremaa | 209/273 |
| 3,865,243 | 2/1975 | Salminen | 209/273 |
| 4,238,324 | 12/1980 | Musselmann et al. | 209/273 |
| 4,356,085 | 10/1982 | Schon et al. | 209/273 |
| 4,396,502 | 8/1983 | Justus | 209/273 |
| 4,440,635 | 4/1984 | Reiniger | 209/306 |
| 4,447,320 | 5/1984 | Lamort | 209/273 |
| 4,462,900 | 7/1984 | Matthew | 209/273 |

FOREIGN PATENT DOCUMENTS

| | | | |
|---|---|---|---|
| 2126821 | 12/1929 | Austria | 209/300 |
| 2384889 | 11/1978 | France | 209/17 |
| 606635 | 5/1978 | U.S.S.R. | 209/273 |
| 399300 | 10/1933 | United Kingdom | 209/305 |

*Primary Examiner*—Donald T. Hajec

*Attorney, Agent, or Firm*—Albert L. Jeffers; Richard L. Robinson

[57] ABSTRACT

A sorting apparatus for sorting fiber suspensions heavily laden with rubbish and other contaminants, which sorter has two successive sorting units each having a ring-shaped strainer space, which are likewise successive, and an accepts space with a rotationally symmetric strainer between the accepts space and strainer space. The first sorting unit is pressurized above atmospheric pressure; diluting water is fed to the second unit strainer space; and a rotating plate is mounted between the first and second sorting units to control the flow between the strainer spaces.

26 Claims, 8 Drawing Sheets

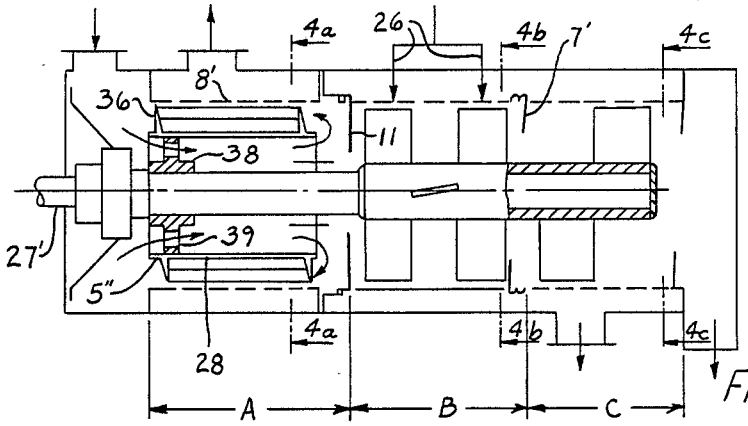
Fig. 4
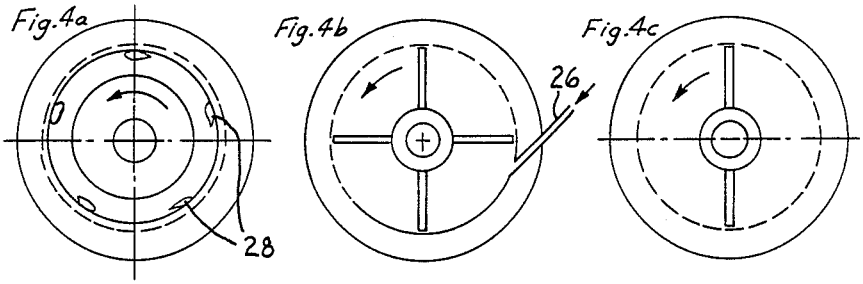
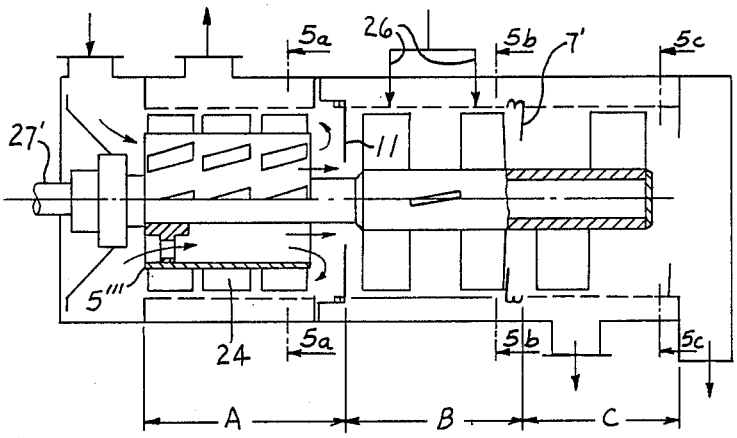
Fig. 5
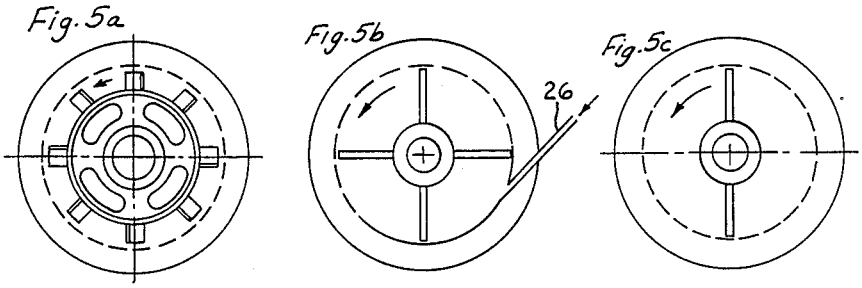

REJECTS SORTING APPARATUS

This is a division of application Ser. No. 015,747, filed Feb. 17, 1987, now abandoned.

The invention concerns a final stage sorting apparatus of the type shown in U.S. Pat. No. 3,98,157.

The machine employed in the final stage of sorting (for instance sorting of waste paper) serves to separate interfering substances (rejects) from usable fiber material. This separation process operates to minimize fiber loss while providing maximum rejects separation. In sorting apparatus of this type the final sorting stage determines the efficiency of the entire sorting process.

Prior final stage sorters, such as vibratory sorters, require relatively large strainer surfaces and strainer perforations as well as high fraction dilutions to achieve any reasonably satisfactory sorting effect. Additionally, the strainers are very susceptible to clogging.

Therefore, final stage sorters have been developed in recent years to replace vibratory sorters, which updated sorters maintain the dry content rejects as high as possible, as described in the German Patent Publication No. 30 06 482. However, the machine disclosed in that patent application is limited to medium purity suspensions.

Another final stage sorter with small perforation strainers is described in the German Patent Publication No. 32 38 742. Tightly (small) perforated sorting strainers have a high energy consumption and a large material loss.

The present invention provides a sorting apparatus that sorts fiber suspensions even if the finest strainer perforations are utilized. The sorter separates the rejects while maintaining the fiber loss as low as possible, and continuously removes the light contaminants in a continuously operating sorter arrangement.

BRIEF DESCRIPTION OF THE DRAWING

In the figures of the drawing like reference numerals identify like components and in the drawings:

FIGS. 2(*a*), 2(*b*), and 2(*c*) are the views along the sectional lines of FIG. 2;

FIGS. 3(*a*), 3(*b*), and 3(*c*) are the views along the sectional lines of FIG. 3;

FIG. 4 illustrates an alternative hydrofoil embodiment for the sorting elements;

FIGS. 4(*a*), 4(*b*), and 4(*c*) are the views along the sectional lines of FIG. 4;

FIG. 5 illustrates a further hydrofoil alternative embodiment for the sorting elements;

FIGS. 5(*a*), 5(*b*), and 5(*c*) are the views along the sectional lines of FIG. 5;

DETAILED DESCRIPTION OF THE INVENTION

Figure 1:
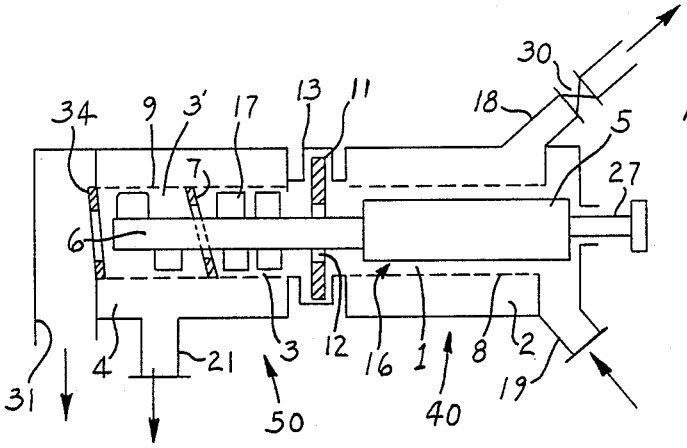
FIG. 1 is a schematic illustration of a sorting apparatus along a horizontal rotor axis with two successive sorting units.

In FIG. 1 the sorting apparatus consists of two successive sorting units 40 and 50 aligned along a horizontal axis. The first sorting unit 40 has a rotationally symmetric, cylindrical strainer 8 surrounding a ring-shaped strainer space 1 which is formed between the strainer 8 and the drum type rotor part 5. This arrangement is illustrated as centrally positioned in sorting unit 40. First sorting unit 40 has a suspension inlet 19 located on its end furthest from the second sorting unit 50, and an outlet 18 from the accepts space 2, which surrounds the strainer 8. Rotor 5 has sorting elements, generally located at 16 in the form of wings or foils which cause a good sorting effect. The rotor is driven by a shaft 27 and a motor or power source not illustrated. Second sorting unit 50, generally similar to first unit 40, consists of an (outer) accepts space 4, inner ring-shaped strainer space 3 or 3', cylindrical strainer 9, and rotor part 6 with sorting elements 17. The sorting elements are simply illustrated as radial ribs. The strainer space 3 or 3' is unpressurized and has a rejects outlet 31 connected at its end 3', which outlet 31 is open to the atmosphere. Accepts space 4 of sorting unit 50 is open to the atmosphere through outlet 21 which is shown as located at the lower part of sorting unit 50. Arranged between the strainer spaces 1 and 3 is a ringlike plate or diaphragm 11 with a gap 12 for the rotor, which diaphragm 11 influences or controls the flow and provides a pressure drop between strainer spaces 1 and 3. This arrangement maintains the pressure in the strainer space 1 relative to the surrounding atmosphere. The accepts space 2 surrounding the strainer space 1 and strainer 8 is sealed from the atmosphere by an outlet valve or side 30 which is a counterpressure means, on the outlet socket 18, and thus accepts space 2 is pressurized. The pressure ranges preferably between 0.4 and 1.6 bars.

The sorting apparatus could also be arranged with a vertically oriented rotor axis. In the illustration of FIG. 1, the horizontal sorting apparatus arrangement has an inclined annular disk 7 having a top point and a bottom point and inclined about the axis of the rotor part 6 with the bottom point toward the ring like diaphragm 11, and acting as a diaphragm and positioned in second strainer space 3. The disk 7 cooperates with the rotor part 6 to define a gap therebetween. The annular disk 7 and the second strainer cooperate to define a first part section and a second part section of the second sorting unit 50. The first part section is in proximity to the first sorting unit 40. Disk 7 causes a certain backup or damming effect in the first strainer space section 1 so that the rejects transfer only gradually into the strainer space section 3' at the outlet end of second sorting unit 50. Diluting water may be added to ensure that a maximum of fibers will be washed out and reclaimed.

Diaphragm 11 is accommodated in a diaphragm casing 13 and may be an adjustable iris type diaphragm. This allows an adjustment of the flow conditions in the suspension being transferred from the first strainer space 1 to the second strainer space 3 during operation of the sorting apparatus. This adjustability or variability is particularly important when greatly different material type are used, for instance different waste paper types. By adjusting the free area or gap 12 of diaphragm 11 and the backpressure in extraction line 18 through valve 30, variations of production rate and contaminant content may be accommodated. For example, if the throughflow is low the backpressure or the free area 12 of the diaphragm 11 may be increased to provide an adequate extraction rate of contaminants in the second sorting section 50, 50'. Generally a pressure increase effected in first sorting section 40, 40' by diaphragm 11 increases the throughflow rate and it is thereafter possible to utilize the finest strainer perforations.

A backup ring 34 on the end of the strainer space 3' adjacent to the rejects outlet 31 prevents too rapid a passage of the suspension through this strainer space. As a result, sufficient time is provided for dehydrating the suspension contained therein, which is heavily laden with contaminants, so that the rejects discharging from rejects outlet 31 are at a high consistency, such as 15, 20 or more percent.

Figure 2:
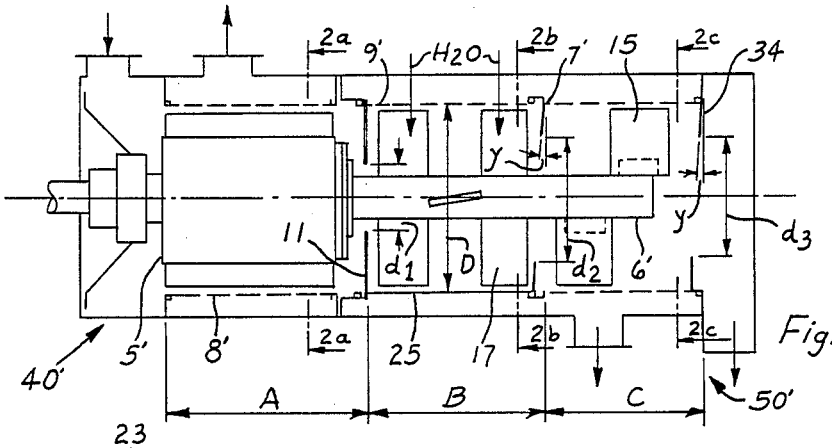
FIG. 2 is a further illustration of FIG. 1 with sectional lines A—A, B—B and C—C.
Figure 2A:
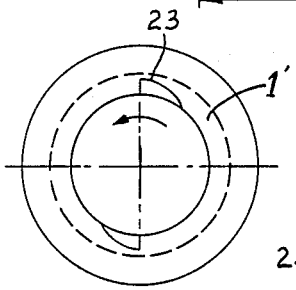
Figure 2B:
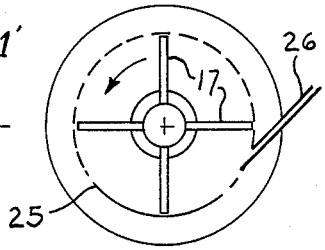
Figure 2C:
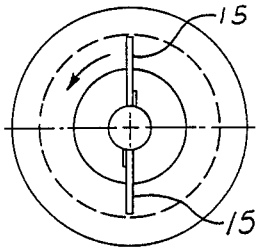

The sorting apparatus, generally as shown in FIG. 1, is defined by three zones marked by capital letters A, B, and C in FIG. 2. The first zone A is related to a sorting section with the rotor 5 or 5' (components which are identical or of similar effect are identically referenced in the figures but are noted with the prime sign). A wash zone, B, which corresponds to the strainer space 3 of FIG. 1, is separated by backup ring 7 or 7' from a third zone C, which is a dehydrating zone.

In FIG. 2 the following diameter ratios are preferred: the inside diameter $d_1$ of gap 12 of the diaphragm 11, in relation to the diameter of the strainer 8 or 8', and strainer 9 or 9', initially noting the diameters as D, is $d_1/D=0.3$ to 0.7; the inside diameter of the backup rings 7 or 7', $d_2$, and 34, $d_3$, relative to the strainer diameter, are $d_2/D=d_3/D=0.4$ to 0.8; and, the angle of inclination, y, of backup rings 7, 7' and 34 relative to the rotor axis is at least 75°, and preferably between 80° and 83°.

The difference in diameter of the strainer 8 or 8', and the strainer 9 or 9', is at most 10% of the larger diameter.

The velocity of the rotor wings or elements at their outer is between 10 and 25 m/s.

The sorting apparatus is provided for final stage sorting (also rejects sorting) and, therefore, requires relatively fine strainer holes. For medium fine sorting, hole diameters of the strainer 8 or 8' are between 0.8 and 2.6 mm in diameter, and for very fine sorting tasks, slotted perforations between 0.15 and 0.8 mm are required. The slot widths for strainer basket 9 or 9' of the second strainer space would be between 0.15 and 0.5 mm.

Diluting water can be added by means of lines 26 connected at a slant, in approximately a tangential direction, to the strainer basket 9 or 9', in the area of ash zone B. Diluting water can be prevented from leaving the strainer space prematurely by utilizing an unperforated area 25 in strainer basket 9 or 9', which serves as a baffle, as illustrated in the cross-section B—B of FIG. 2.

Figure 3:
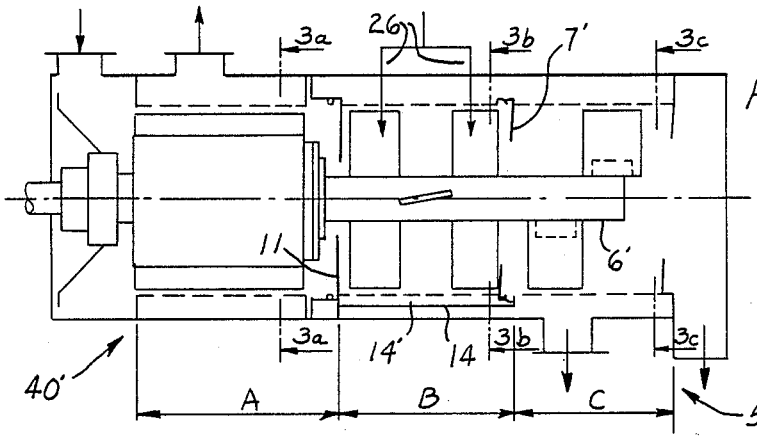
FIG. 3 illustrates an alternative embodiment of a baffle arrangement as shown in FIG. 2.
Figure 3A:
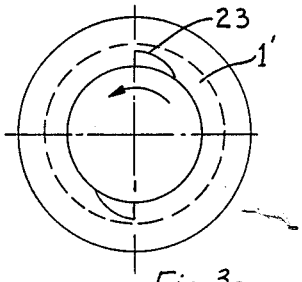
Figure 3B:
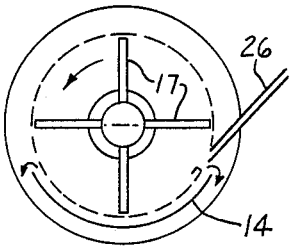
Figure 3C:
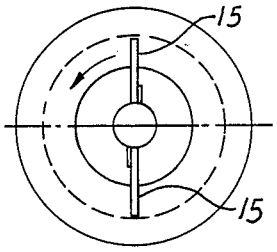

An additional baffle 14 for inhibiting the drainage of the diluting water can be installed in area B, which baffle 14 is shown in FIG. 3 as a trough below the strainer 9 or 9'. A backup or dam space 14' is thus provided in this area below the strainer basket 9 or 9', which prevents too rapid drainage of the diluting liquid from that strainer space, as the liquid backed up against the baffle 14 inhibits flow from the suspension in the strainer space. The rotor elements serving to churn the suspension in the strainer space 1 or 1', of first sorting unit 40 or 40' may be hydrofoils 16. Alternatively, the rotor elements may be projections 23 with a radial impact surface and a sharp edge extending in the direction of rotation as illustrated in FIGS. 2 A—A and 3 A—A. These rotor elements are continuous slats extending across the length of the rotor. But they may also be repeatedly subdivided and approximately evenly distributed as shorter elements across the cylindrical surface of the rotor drum.

Figure 11:
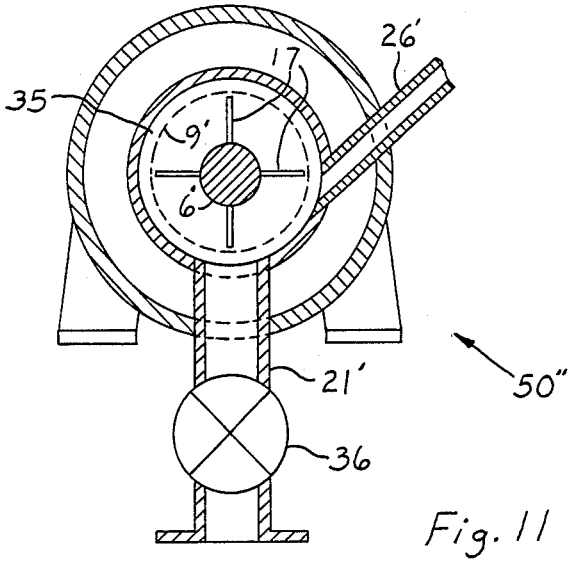
Figure 12:
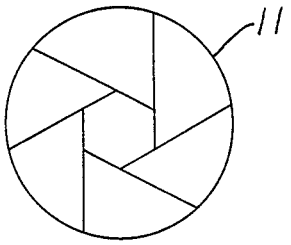
FIG. 12 is a schematic illustration of the iris type diaphragm 11.

As shown in FIG. 4, so-called hydrofoils, that is rotor wings having an air foil profile, are provided on the first rotor section, which hydrofoils are about the same length as the rotor part. The rotor elements 28 are mounted on the helical surfaces provided on the two front ends of the rotor part 5''. These helical surfaces are formed by single-start worm feeds 36. The embodiment shown in FIG. 11 is a cross-sectional view of the washing zone B, the first section of the second sorting unit 50, 50', with strainer 9, 9' surrounded by a closed ringlike chamber 35 connected to an extraction line 21' at the underside, preferably the bottom thereof. Extraction line 21' extends out of units 50, 50' and has a control valve 36 therein, which valve 36 is operable to control the outflow from ringlike chamber 35. Outflow control through valve 36 provides an inhibiting force or a damlike structure for the slushed or viscous suspension.

First rotor section 5''' in FIG. 5 has rotor wings in the form of slanted ribs. This slanted position produces a faster flow of the suspension from the suspension inlet axial end t the second axial end of rotor 5''' in proximity to the second sorting unit.

Rotor parts 5'' and 5''' in FIGS. 4 and 5, respectively, have as a basic body, an open support drum, which on one end is held on the rotor shaft 27' by means of support flanges 38 with bores 39. The introduced suspension first flows in an axial direction through bores 39, which are at one end of the rotor drum near the rotor shaft, and through the rotor drum toward the other axial end of the rotor drum. At the other or second axial end of the rotor drum the flow is reversed and proceeds to sorting elements 28 and 29 to be sorted by strainer 8'. Work feeds 36 are designed so that, depending on the direction of rotation, they will aid the flow of the suspension to the sorting elements 24 and 28. The suspension is thereby recirculated. Recirculation of the rejects retained on the strainer allows capture of the concentrated rejects; contaminants, which are lighter in specific gravity, are concentrated in the center of the rotor drum 5''; and more long fibers are sorted out, passing through the strainer 8', and routed to the accepts. Thus the subsequent washing and water removal operation are enhanced and the fiber loss is reduced as well.

Figure 6:
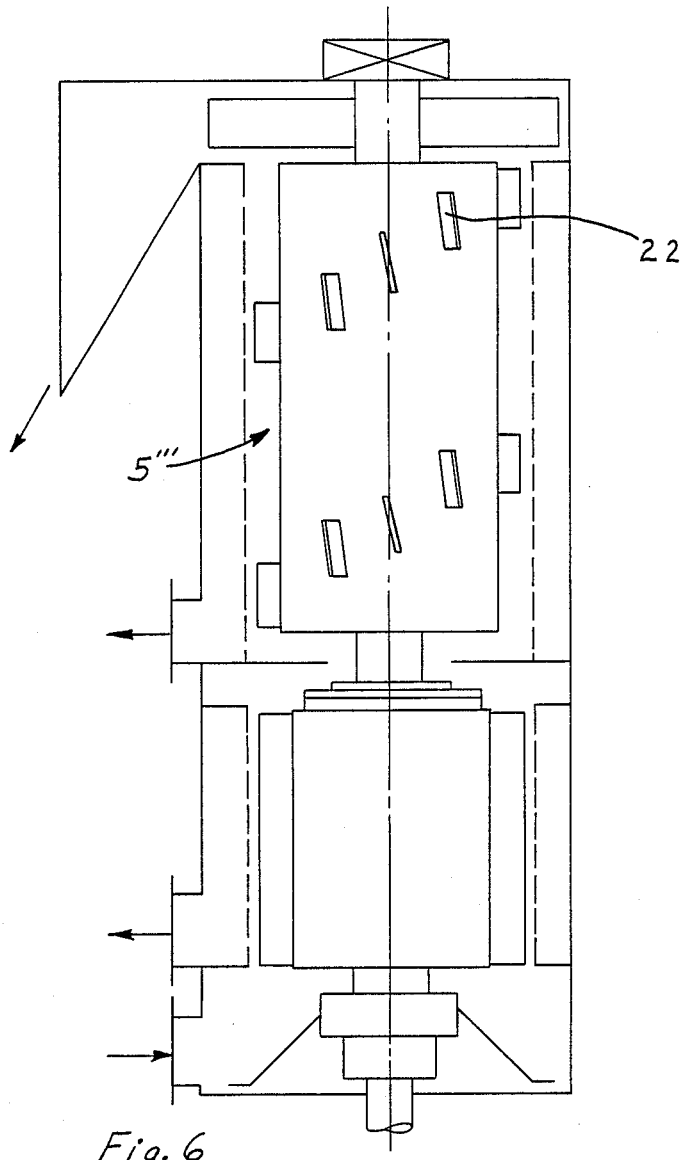
FIG. 6 illustrates a vertically oriented sorting apparatus.
Figure 7:
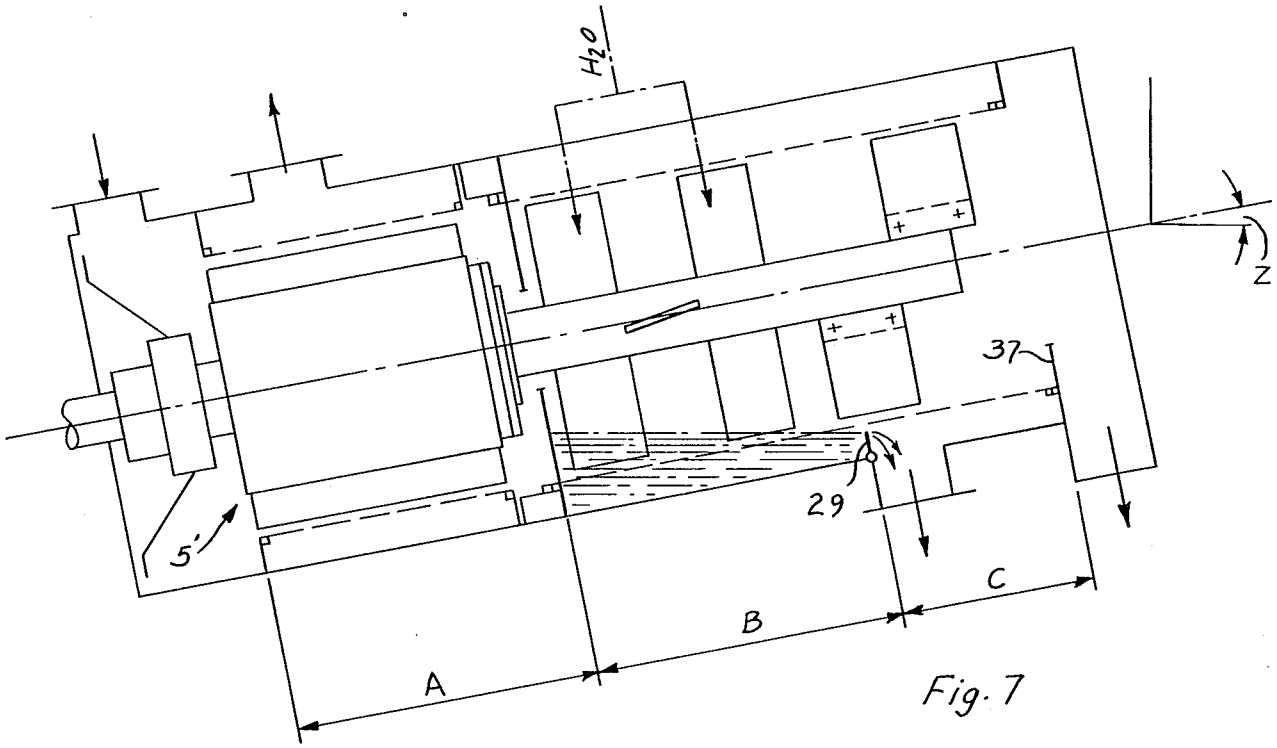
FIG. 7 illustrates a sorting apparatus with an inclined rotor axis.

In second sorting section 50, which has the wash zone B and water removal zone C, rotor elements in the form of simple ribs or plates are preferably used, which in FIGS. 1 through 5 are referenced 15 and 17. In the case of FIG. 6, these plates 22 are somewhat slanted relative to the generatrix of the cylinder surface of the rotor. Plates 22 are distributed across the cylinder surface approximately helically. The sorting apparatus in FIG. 6 has a vertical orientation. Therefore, a backup ring on the second rotor 5''' for forming a lower wash zone and an upper water removal zone is not needed as the wash water naturally remains in the lower area due to gravity. In the apparatus shown in FIG. 7, a backup ring on the second rotor is also not needed as the rotor axis is inclined at a small angle 'z' relative to the horizontal, which angle 'z' may be between 15° and 45°, so that the first rotor 5' is situated lower relative to the second rotor. In this embodiment water removal zone C is separated from wash zone B by means of a weir 29, which may be adjustable. An outlet backup ring s not required in this embodiment, but a weir 37 may be provided in the lower area of the water removal zone C, which weir 37 causes an appropriate backup or damming effect.

Figure 8:
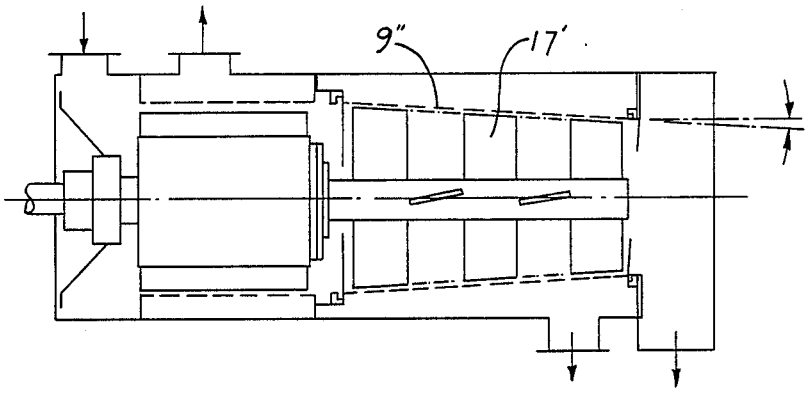
FIG. 8 illustrates an alternative arrangement of the second strainer basket and sorting section.

FIG. 8 illustrates that the second strainer basket 9'' of the second sorter section 50'' tapers inwardly toward the outlet end in the overflow 31. The conical taper is about between 3° and 6°, as illustrated. The taper could also be considerable greater. The radially outer edge of the sorting wings 17' are appropriately sloped to accommodate this conical strainer shape. This arrangement improves the dehydration of the rubbish (rejects).

Figure 9:
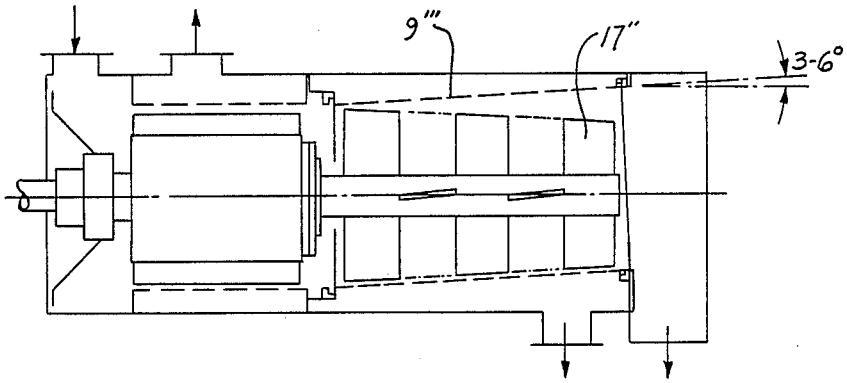
FIG. 9 discloses another embodiment of a second strainer basket and sorting section.

In FIG. 9, the strainer basket 9''' of the second sorting section 50''' has a cylindrical design with a center axis slanting upwardly relative to the center axis of the rotor toward the overflow end 31. This slant could also be selected between 3° and 6°, as in FIG. 8. The radially outer edge of the rotor wings 17''', which are on horizontal rotor 6' must also accommodate the inclination of the cylinder, as in FIG. 8.

Figure 10:
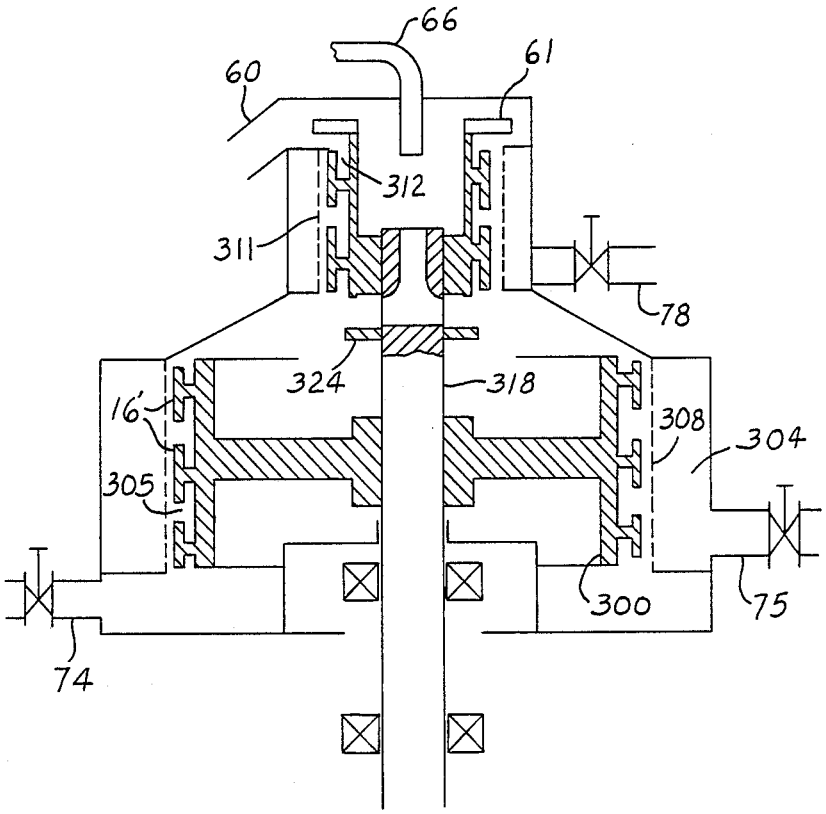
FIG. 10 illustrates an alternative embodiment of the sorting apparatus with a vertical orientation; and, FIG. 11 is a cross-sectional view generally of second sorting section wash zone with an extracting line and valve arrangement.

The sorting apparatus illustrated in FIG. 10 has a vertical orientation. In the first section sorting unit a ring-shaped strainer space 305 is formed between a rotationally symmetric strainer basket 308 and a drum type rotor section 300, which supports the sorting elements 16'. The diameter of he first strainer 308 is considerably larger than that of the second strainer 311 in the second sorting unit by more than 20%, twenty percent. This sorting arrangement accommodates suspensions with a relatively low share of contaminants, but high throughput quantities. The suspension is introduced through line 74 and the cleaned fiber suspension is drained from accepts space 304 through line 75. Diluting water may be added in the second strainer space 312 through line 66 and perforation in the upper drum-shaped rotor section. Diluting water may also be provided through the hollow upper part of shaft 318 in the transitional area between the first and the second strainer space. A backup plate 324 is mounted on the rotor shaft 318. The cleaned fiber suspension is removed radially behind the second strainer 311 through the line 78. A number of ejection blades 61, which preferably extend radially outward, are provided in this structure on the drum part of the rotor at the rejects outlet of the second strainer space 312, which blades facilitate the transfer of the rejects into the removal chute 60.

Those skilled in the art will recognize that certain variations can be made in the illustrated embodiments. While only specific embodiments of the invention have been described and shown, it is apparent that various alterations and modifications can be made therein. It is, therefore, the intention in the appended claims to cover all such modifications and alterations as may fall within the true scope and spirit of the invention.

What is claimed is:

1. A sorting apparatus for sorting fiber suspensions which are heavily laden with rubbish and other contaminants, said sorting apparatus comprising:

a first sorting unit and a second sorting unit successively arranged;

a rotor mounted in said apparatus and extending through said first and second sorting units;

a first and second rotationally symmetric strainer for each of said first and second sorting units, respectively, and mounted therein;

a first and second ring-shaped strainer space defined between said rotor and said strainer in each of said first and second sorting units, respectively, which strainer spaces are immediately successively arranged;

means for providing diluting water to said second strainer space;

said first sorting unit at a pressure above atmospheric pressure and above that of said second sorting unit;

each of said strainers and said first and second sorting units cooperating to define a first accepts space and a second accepts space therebetween, respectively, which accepts spaces are radially outward of said strainers;

means located at transition from said first sorting unit to said second sorting unit for providing a pressure drop thereat by restricting the flow between said first strainer space and said second strainer space, said means including a ringlike diaphragm mounted and operable between said first sorting unit and said second sorting unit.

2. A sorting apparatus as claimed in claim 1 further comprising an outlet socket which outlet is open to said first accepts space and has a valve means mounted therein for selectively controlling flow through and sealing said outlet.

3. A sorting apparatus as claimed in claim 1 wherein said second strainer space defines a first end in proximity to said first strainer space and a second end; said second strainer space having a rejects outlet (31) open to atmospheric pressure at said second end and said second sorting unit defines at least one accepts space outlet open to the atmosphere and providing communication from said second unit accepts space.

4. A sorting apparatus as claimed in claim 1 wherein said second strainer space and second accepts space are at atmospheric pressure.

5. A sorting apparatus as claimed in claim 1 further comprising sorting elements mounted and operable on said rotor in each of said first and second strainer spaces.

6. A sorting apparatus as claimed in claim 5 wherein said sorting elements in said second sorting unit are ribs, which have a compact cross section.

7. A sorting apparatus as claimed in claim 5 wherein said sorting elements in said first sorting unit are blocks which have a straight, essentially radial edge forwardly situated in the direction of rotation and a steadily tapering rear edge.

8. A sorting apparatus as claimed in claim 5 wherein said sorting elements in said second sorting unit are plate-shaped ribs which radially extend from said rotor and are longitudinally aligned on said rotor in at least one row.

9. A sorting apparatus as claimed in claim 1 wherein said first strainer has a first diameter and said second strainer has a second diameter, one of said first diameter and second diameter being larger than the other, said diameters having a diameter difference therebetween, which diameter difference is at the most ten percent of said larger diameter.

10. A sorting apparatus as claimed in claim 1 wherein said ringlike diaphragm is adjustable.

11. A sorting apparatus as claimed in claim 10 wherein said adjustable ringlike diaphragm is an iris type diaphragm.

12. A sorting apparatus as claimed in claim 1 further comprising an annular disk mounted in said second strainer space and cooperating with said rotor to define a gap therebetween;

said annular disk and second unit strainer cooperating to define a first part of said second strainer space in proximity to said first sorting unit and a second part of said second sorting space;

said rotor defining a rotor axis;

said annular disk having a top point and a bottom point, and inclined about said rotor axis from said top point to said bottom point toward said ringlike diaphragm.

13. A sorting apparatus as claimed in claim 12 wherein said means for providing diluting water communicates with said first part of said second strainer space, which first part is operable as a diluting and wash zone and which second part is a dehydrating zone.

14. A sorting apparatus as claimed in claim 1 wherein the second strainer has a diameter and the seconds strainer space has a radial expanse defined between the rotor and the strainer of the second strainer space, and said radial expanse said second accepts space is at least twenty percent of the second strainer diameter.

15. A sorter apparatus as claimed in claim 1 wherein said rotor defines a rotor axis;

said rotor and rotor axis inclined at an angle from the horizontal;

said first sorting unit and second sorting unit generally longitudinally aligned along said rotor axis;

said second sorting unit having a bottom;

a bottom weir mounted and operable in said second sorting unit bottom, said bottom weir operable to restrict flow through said second sorting unit and defining a wash zone and a dehydrating zone in said second sorting unit.

16. A sorting apparatus as claimed in claim 12 further comprising a ringlike chamber mounted in said first part of said second sorting unit, which ringlike chamber has a bottom region and surrounds said second strainer;

an extraction line extending from said chamber to the exterior of said second sorting unit and communicating therebetween, which line is positioned at said ringlike chamber bottom region, and, a control valve in said extraction line, which control valve is operable to control the outflow from said ringlike chamber, thereto being also connected a diluting water line.

17. A sorting apparatus for sorting fiber suspensions which are heavily laden with rubbish and other contaminants, said sorting apparatus comprising:

a first sorting unit and a second sorting unit successively arranged;

a rotor with a rotor axis mounted in said apparatus and extending through said first and second sorting units;

a first and second rotationally symmetric strainer for each of said first and second sorting units, respectively, and mounted therein;

a first and second ring-shaped strainer space defined between said rotor and said strainer in each of said first and second sorting units, respectively, which strainer spaces are immediately successively arranged; sorting elements mounted and operable on said rotor in each of said first and second strainer spaces;

said second strainer space defining a first end in proximity to said first strainer space and a second end, said second sorting unit defining a rejects outlet open to atmospheric pressure at said second end;

means for providing diluting water to said second strainer space;

said first sorting unit at a pressure above atmospheric pressure;

each of said strainers and said first and second sorting units cooperating to define a first accepts space and a second accepts space therebetween, respectively, which accepts spaces are radially outward of said strainers, said second sorting unit further defining at least one accepts space outlet open to the atmosphere and providing communication from said second accepts space;

said first sorting unit having an outlet socket operable to communicate suspension from said first accepts space and having a control valve in said outlet socket to control or seal suspension flow therethrough;

a ringlike diaphragm mounted and operable between said first sorting unit and said second sorting unit, which diaphragm is operable to restrict the flow between said first strainer space and said second strainer space;

an annular disk mounted in said second strainer space cooperating with said rotor to define a gap therebetween, which annular disk and second strainer cooperating to define a first part of said second strainer space in proximity to said first sorting unit and a second part of said second strainer space, said annular disk having a top point and a bottom point and inclined about said rotor axis with said bottom point toward said ringlike diaphragm.

18. A sorting apparatus as claimed in claim 17 wherein said sorting elements in said second sorting unit are ribs, which having a compact cross section.

19. A sorting apparatus as claimed in claim 17 wherein said sorting elements in said first sorting unit are blocks which have a straight, essentially radial edge forwardly situated in the direction of rotation and a steadily tapering rear edge.

20. A sorting apparatus as claimed in claim 17 wherein said sorting elements of said second sorting unit are plate-shaped ribs which radially extend from said rotor and are longitudinally aligned on said rotor in at least one row.

21. A sorting apparatus as claimed in claim 17 wherein said first strainer has a first diameter and said second strainer has a second diameter, one of said first diameter and second diameter being larger than the other, said diameters having a diameter difference therebetween, which diameter difference is at the most ten percent of said larger diameter.

22. A sorting apparatus as claimed in claim 17 wherein said ringlike diaphragm is adjustable.

23. A sorting apparatus as claimed in claim 17 wherein said adjustable ringlike diaphragm is an iris type diaphragm.

24. A sorting apparatus as claimed in claim 17 wherein said means for providing diluting water communicates with said first part of said second strainer space, which first part is operable as a diluting and wash zone and which second part is a dehydrating zone.

25. A sorting apparatus as claimed in claim 17 wherein the second strainer has a diameter and the second strainer space has a radial expanse defined between the rotor and the strainer of the second strainer space and said radial expanse is at least twenty percent of the second strainer diameter.

26. A sorting apparatus as claimed in claim 17 further comprising a ringlike chamber mounted in said first part of said second sorting unit, which ringlike chamber has a bottom region and surrounds said second strainer;

an extraction line extending from said chamber to the exterior of said second sorting unit and communicating therebetween, which line is positioned at said ringlike chamber bottom region; and, a control valve in said extraction line, which control valve is operable to control the outflow from said ringlike chamber.

* * * * *